United States Patent [19]

Chang

[11] Patent Number: 4,995,245

[45] Date of Patent: Feb. 26, 1991

[54] EVAPORATOR FOR ICE MAKER

[75] Inventor: Eui Y. Chang, Seoul, Rep. of Korea

[73] Assignee: SamSung Electronics Co., Ltd., Suweon, Rep. of Korea

[21] Appl. No.: 416,677

[22] Filed: Oct. 5, 1989

[30] Foreign Application Priority Data

Oct. 6, 1988 [KR] Rep. of Korea ..... 88-16501

[51] Int. Cl.[5] ..... F25B 39/02

[52] U.S. Cl. ..... 62/515; 62/347; 165/135; 403/340

[58] Field of Search ..... 62/347, 515, 348, 352; 165/135; 403/340, 364

[56] References Cited

U.S. PATENT DOCUMENTS

| | | | |
|---|---|---|---|
| 3,206,944 | 9/1965 | Gallo | 62/347 |
| 3,280,588 | 10/1966 | Brindley | 62/347 X |
| 4,589,261 | 5/1986 | Ohashi et al. | 62/347 X |
| 4,590,774 | 5/1986 | Povajnuk | 62/347 |
| 4,823,559 | 4/1989 | Hagen | 62/347 |

*Primary Examiner*—William E. Tapolcai

*Attorney, Agent, or Firm*—Robert E. Bushnell

[57] ABSTRACT

An evaporator for ice maker comprises having a plate and spacer with heat conductivity of the plate being higher than of the spacer so that the evaporator can separate the ice cubes easily, thus enabling the plate and the spacer to be manufactured easily with interengaging connecting means.

20 Claims, 4 Drawing Sheets

EVAPORATOR FOR ICE MAKER

BACKGROUND OF THE INVENTION

1. Field of the Invention

The present invention relates to an evaporator for an ice maker, particularly it relates to an evaporator having a plate inclusive of an evaporating pipe, spacing means and packing means preventing heat conduction.

More particularly, it relates to the evaporator assemble from the plate means having a low heat conductivity.

The evaporator also allows developing heat conductivity, easy assembling and easy removing of ice cubes.

2. Related Arts

Most conventional ice makers include a compressor, a condenser, an evaporator and an injection nozzle.

For the prosecution of ice cubes, high temperature and high pressure refrigerant from the compressor and the condenser is evaporated at the evaporator whereby the surface of the evaporator is cooled.

Then, water is injected on the surface of the evaporator by the injection nozzle.

Accordingly, the water is frozen as ice cubes.

FIG. 5 represents the prior art evaporator as an exploded view.

Evaporating pipe 4' is attached between plates means (8') inclusive of spacing means 9''.

Said evaporating pipe 4' is welded with plate means 8' and so there needs low temperature welding for the preventing surface of plate means from damage.

Accordingly, the prior art requires substantial time for welding during assembling and also it is impossible to totally weld the evaporating pipe with plate means, consequently heat conductivity is low.

SUMMARY OF THE INVENTION

The object of the present invention is to provide easy assembling and efficient ice making.

Embodiments of the disclosed invention may be mainly constructed with plate means, spacing means, packing means and connecting means.

Spacing means forms prominence means and depression means by turns at the contacting face to the plate means.

In assembling, the spacing means are connected with the prominence means and the depression means and so the plate means and the spacing means are assembled in a body.

Consequently, embodiments of the disclosed invention are amenable to easy assembling and so it can make ice cubes efficiently.

BRIEF DESCRIPTION OF THE INVENTION

The foregoing and other objects, features and advantages of the present invention should become apparent from the following description taken in conjunction with the accompanying drawings, in which.

DETAILED DESCRIPTION OF THE PREFERRED EMBODIMENT

Figure 1:
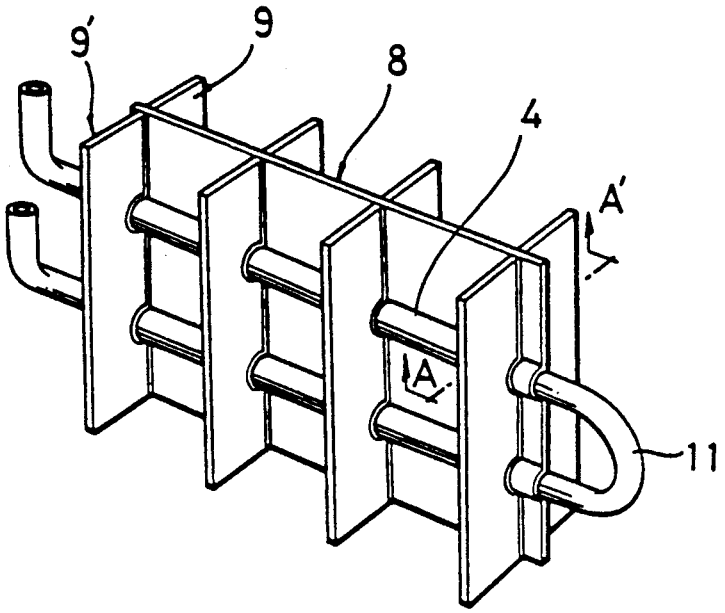
FIG. 1 is a perspective view of a preferred embodiment of the invention.
Figure 2:
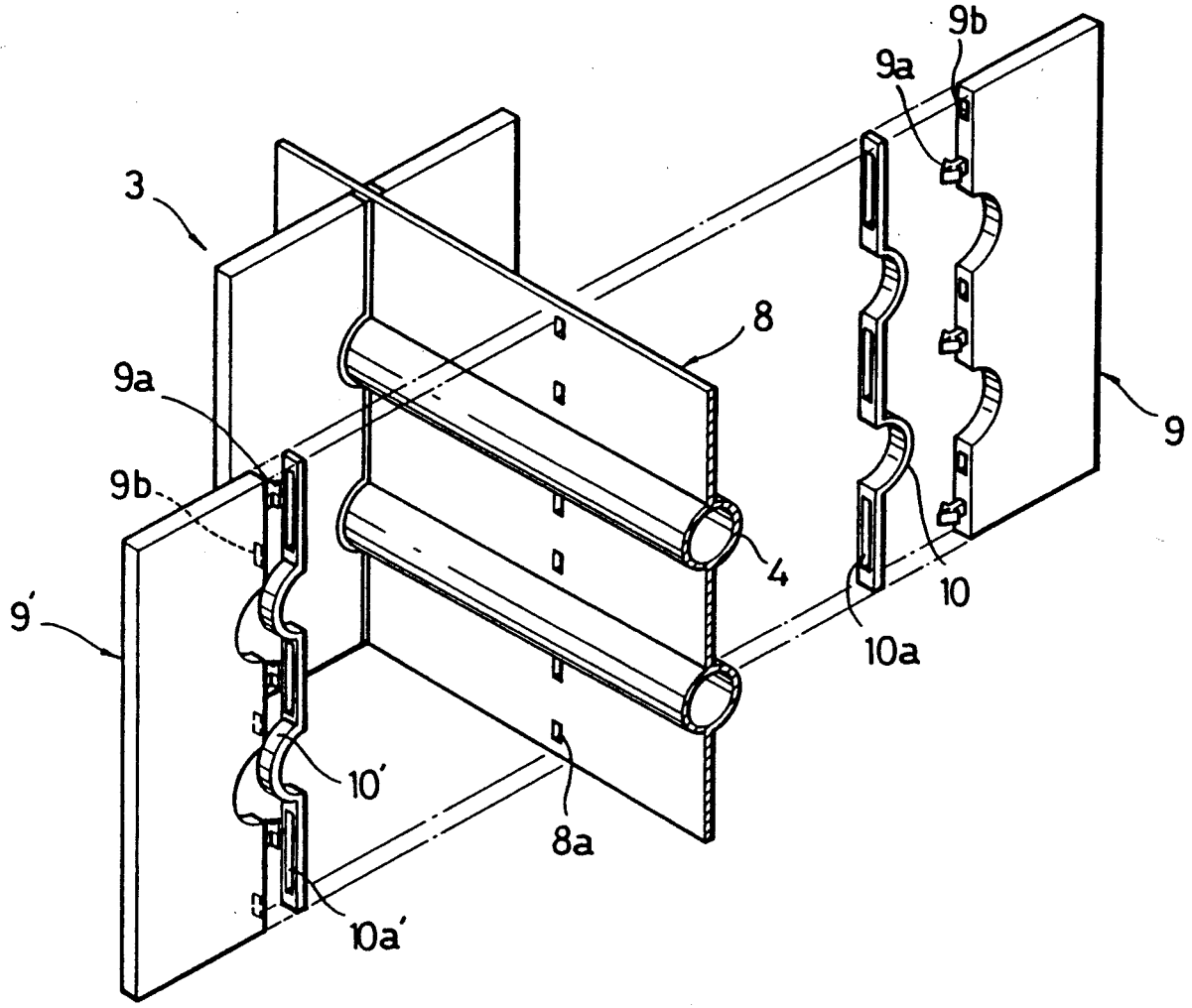
FIG. 2 is an exploded view of an evaporator according to the presentation.

Referring now to FIGS. 1 and 2, the disclosed embodiment include plate means 8 inclusive of evaporating pipe 4, spacing means 9, 9' and connecting means which connects the spacing means 9, 9' and the plate means 8, packing means 10, 10' which limits heat conduction.

The plate means 8, which is a good heat conductivity, forms evaporating pipes 4 horizontally in a body as an extruding and the ends of the evaporating pipes 8 are coupled as a conventional curved connector 11.

The plate means 8 also forms multiple inserting holes 8*a* vertically for connecting the spacing means 9, 9'.

The spacing means 9, 9', which have a low heat conductivity, forms multiple prominence means 9*a*, 9*a*' and depressing means 9*b*, 9*b*' by turns.

Figure 3:
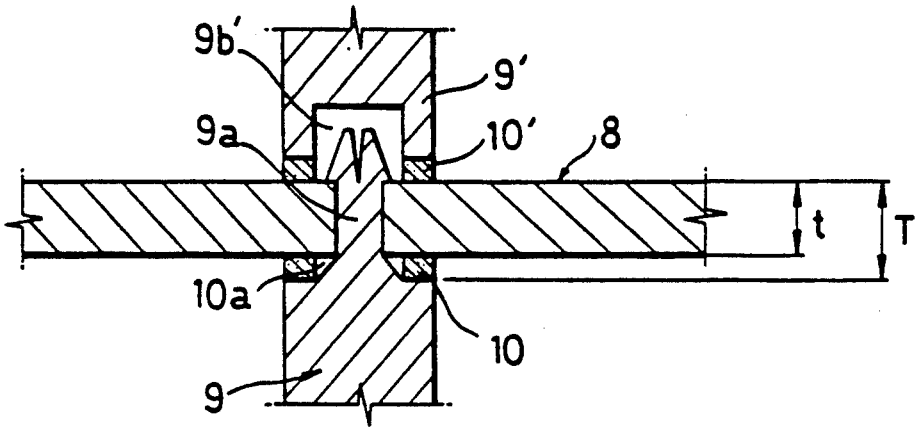
FIG. 3 is a horizontal sectional view taken along line A—A' in FIG. 1.

The packing means 10, 10' have holes 10*a*, 10*a*' for inserting the prominence means 9*a*, 9*a*' into the depression means 9*b*, 9*b*' respectively as in FIGS. 2 and 3.

In FIG. 3, t is thickness of plate 8 and T is thickness of plate 8 with plate 10. Thickness of packing 10, 10' is greater than the difference in thickness (T−t) and so it maintains air tightness during assembly.

During assembly, a plate 8 inclusive of evaporating pipes 4 in a body has inserting holes 8*a*. Then, the prominence 9*a*, 9*a*' of spacing means 9, 9*a*' are inserted into the opposite sides of depressions 9*b*, 9*b*' respectively. And also the prominence 9*a*, 9*a*' are inserted into the depressions 9*b*, 9*b*' through the long holes 8*a* and the long holes 10*a*', 10*a* sequentially as in FIG. 3.

Figure 4:
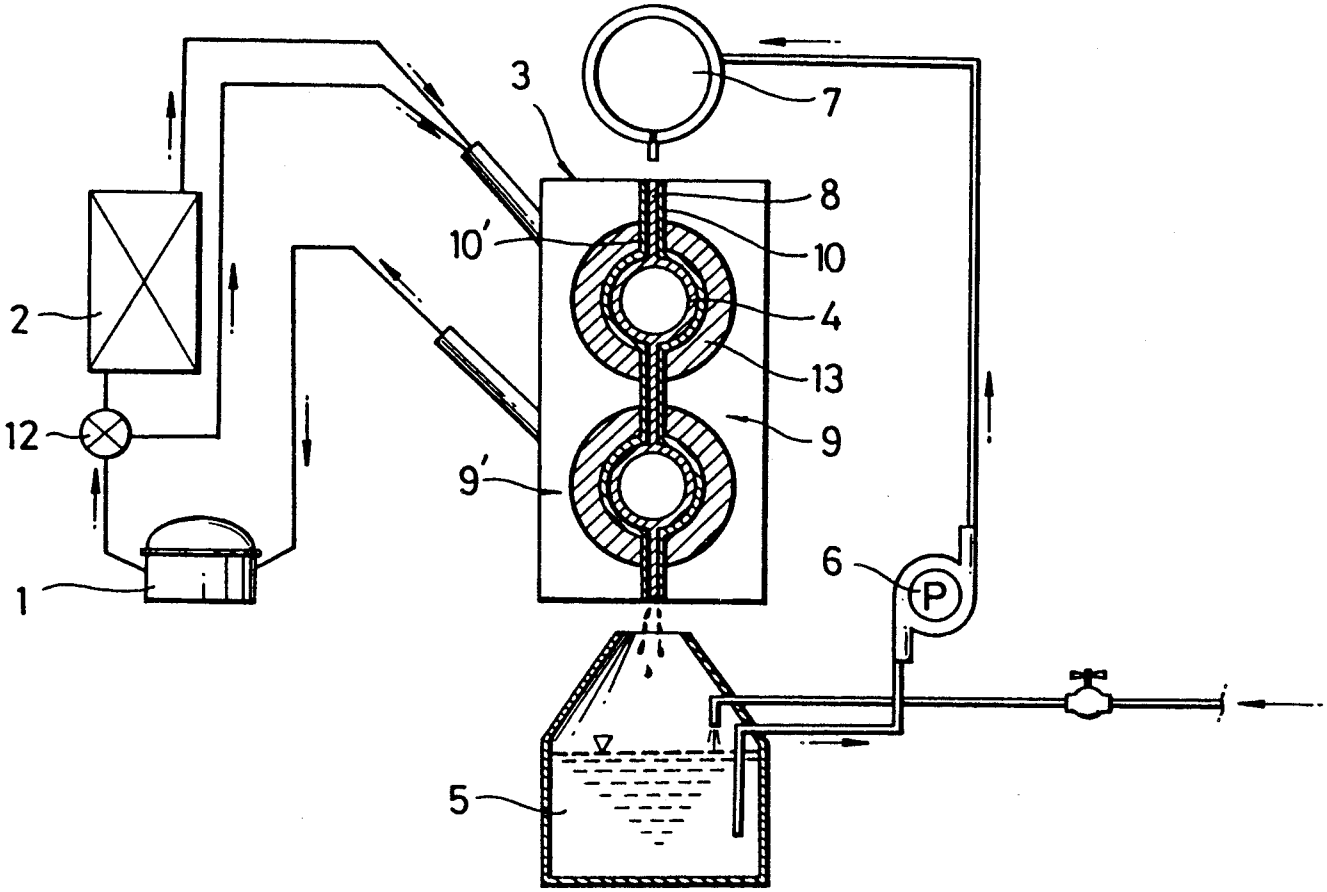
FIG. 4 is a system view for illustrating the operation of ice maker inclusive of the present invention.
Figure 6:
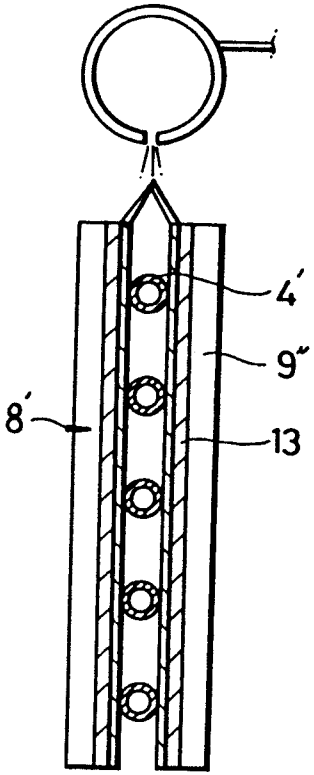
FIG. 6 (PRIOR ART)
FIG. 6 is a vertical sectional view of the prior evaporator in making ice.
Figure 5:
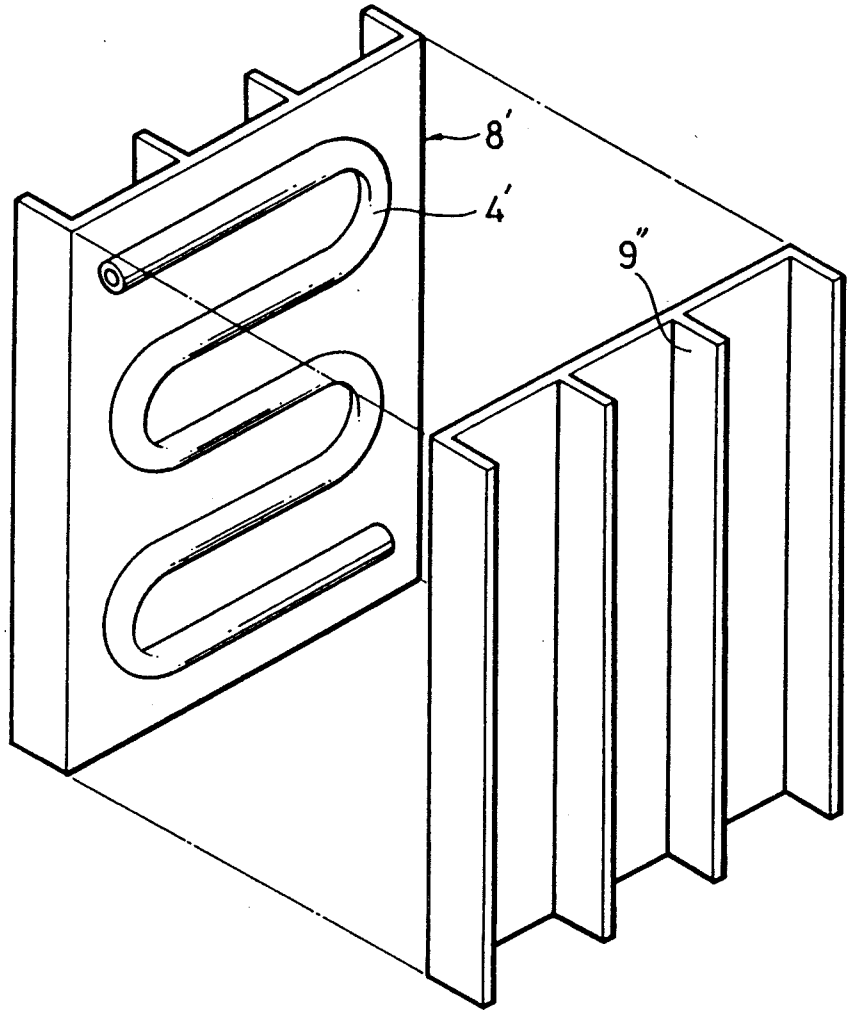
FIG. 5 (PRIOR ART)
FIG. 5 is an exploded view of prior evaporator.

FIG. 4 represents the ice maker system using evaporator of the present invention.

Compressed air by compressor 1 is condensed at a condenser 2 to a high temperature and a high pressure.

The condensed air is evaporated on the surface of the evaporating pipes 4 at the evaporator 3.

The associated apparatus includes a water tank 5, a water circulation pump 6, an injection nozzle 7, and a two direction valve 12.

If the compressor is tuned on, the compressed refrigerant is condensed at condenser 2. Then the condensed refrigerant of high temperature and high pressure is evaporated at evaporator 3. At the same time the water from water tank 5 is injected on the surface of evaporating pipes 4. And so, evaporator 3 gradually turns water from water tank 5 into ice cubes 13 on the surface f the evaporating pipes 4.

If the ice cubes 13 become larger than a certain size, a user may turn the water circulation pump 6 off and also turn the valve in the opposite direction. Then, the compressed referigerant is transmitted to evaporator 3 and the ice cubes 13 on the surface of evaporating pipes 4 fall down due to circulation of the compressed refrigerant of high temperature.

After separating the ice cubes from the evaporating pipes 4, refrigerant of high temperature and high pressure is supplied to the condenser 2 from the compressor 1 by turning the valve 12 to the first direction.

And then, the refrigernat can circulate to a conventional route and also the water is supplied to the evaporator 3 through injection nozzle 7. At that time evaporator 3 gradually turns the water into ice cubes 13 on the surface of the evaporating pipes 4. As mentioned above, it repeats manufacturing ice.

The evaporator 3 of the present invention includes plate 8 and spacers 9, 9'; spacers 9, 9' are fixed into the plate 8 through packing 10, 10'.

But generally, packing means have a characteristic of low heat conductivity so that the temperature of the spacers 9, 9' is higher than heat of plate 8 in cooling the evaporating pipes 4.

The spacers 9, 9' also have a characteristic of lower heat conductivity than that of plate 8.

So, present invention can save the time for separating cubes 13.

In making ice cubes 13, as the temperature of spacer 9, 9' is higher than that of plate 8, the ice cubes 13 can not be fixed to the spacing mean 9, 9' tightly.

So, it can separate ice cubes 13 from the evaporating pipe 4 efficiently.

As mentioned above, present invention enables any assembling of the evaporator which advantageously allows separation of ice

What is claimed is:

1. An evaporator for ice maker, comprising:

plate means made of a material exhibiting good heat conductivity and joined together in a unitary body, for forming therein a plurality of evaporating pipes arrayed in said unitary body between said plate means;

a plurality of separating means made of a substance exhibiting a characteristic of low heat conductivity disposable in pairs of said separating means each extending across said evaporating pipes on opposite sides of said unitary body, with each of said separating means in each said pair being interconnected through said unitary body; and connecting means formed as integral elements of each of said separating means, for joining each said pair of the separating means with the unitary body of the plate means.

2. The evaporator of claim 1, further comprised of each of said separating means being substantially identical discrete elements.

3. The evaporator of claim 1, further comprised of:

said separating means each having an aligned file of alternate prominences and depressions configured to matingly receive said prominences, with the prominences of each of said separating means extending through said holes of said plate means and matingly engaging corresponding one of said holes while being received by the depressions of corresponding ones of said separating means disposed opposite said plate means.

4. The evaporator of claim 1, further comprised of packing means disposed between said separating means and plate means, for retarding leakage via said holes of the water ejected onto surface of the plate means.

5. The evaporator of claim 3, further comprised of packing means disposed between said separating means and plate means with a plurality of apertures accommodating passage of said prominences through said holes, for retarding leakage via said holes of the water ejected onto surface of the plate means.

6. An evaporator for an ice maker, comprising:

plate means joined together as a unitary body with interior wall surfaces of said plate means for providing a plurality of spaced apart evaporating pipes extending between said plate means, and having a plurality of spaced-apart files of holes formed between, each of said evaporating pipes and extending through said plate means;

separating means installable on opposite sides of and centered around said plate means, with components of said separating means integrally formed as part of said separating means being coupled to said plate means along said files and through said holes of said unitary body in spaced apart pairs with each of said pairs being joined via different ones of said files of holes; and supply means for ejecting water onto surfaces of said plate means.

7. The evaporator of claim 6, further comprised of:

said separating means each having an aligned file of alternate prominences and depressions configured to matingly receive said prominences, with the prominences of each of said separating means extending through said holes of said plate means and matingly engaging corresponding ones of said holes while being received by the depressions of corresponding ones of said separating means disposed opposite said plate means.

8. The evaporator of claim 6, further comprised of packing means disposed between said separating means and plate means, for retarding leakage via said holes of the water ejected onto surface of the plate means.

9. The evaporator of claim 7, further comprised of packing means disposed between said separating means and plate means, for retarding leakage via said holes of the water ejected onto surface of the plate means.

10. The evaporator of claim 6, further comprised of said separating means being constructed of a plurality of substantially identical discrete elements.

11. The evaporator of claim 7, further comprised of said separating means being constructed of a plurality of substantially identical discrete elements.

12. The evaporator of claim 6, further comprised of:

said separating means each having an aligned file of alternate prominences and depressions configured to matingly receive said prominences, each said file of alternate prominences and depressions conforming with said files of holes of said plate means, with the prominences of each of said separating means extending through said holes of said plate means and matingly engaging corresponding ones of said holes while being received by the depressions of corresponding ones of said separating means disposed opposite said plate means.

13. The evaporator of claim 12, further comprised of packing means disposed between said separating means and plate means, for retarding leakage via said holes of the water ejected onto surface of the plate means.

14. The evaporator of claim 12, further comprised of packing means disposed between said separating means and plate means with a plurality of apertures accommodating passage of said prominences through said holes, for retarding leakage via said holes of the water ejected onto surface of the plate means.

15. An evaporator for an ice maker, comprising:

plate means joined together as a unitary body with interior wall surfaces of said plate means providing a plurality of spaced apart evaporating pipes said pipes extending between said plate means and being spaced apart by intermediate web sections of said plate means, said web sections being perforated by a plurality of holes aligned in spaced-apart files of pairs of said holes; and separating means installable on opposite sides of said plate means, with components of said separating means that are integrally formed as part of said separating means and are placed on one side of said plate means being coupled together through said plate means along said files of pairs of holes in said plate means with said components of said separating means that are disposed on opposite side of said plate means, with pairs of said components being joined via different ones of said holes.

16. The evaporator of claim 15, further comprised of:

said separating means each having an aligned file of alternate prominences and depressions configured to receive said prominences, with the prominences of each of said separating means extending through said holes of said plate means and engaging corresponding ones of said holes while being received by the depressions of corresponding ones of said separating means disposed opposite said plate means.

17. The evaporator of claim 15, further comprised of packing means disposed between said separating means and plate means, for retarding leakage via said holes of the water ejected onto surface of the plate means.

18. The evaporator of claim 16, further comprised of packing means disposed between said separating means and plate means, for retarding leakage via said holes of the water ejected onto surface of the plate means.

19. The evaporator of claim 15, further comprised of said separating means being constructed of a plurality of substantially identical discrete elements.

20. The evaporator of claim 15, further comprised of:

said web portions defining relatively planar regions separated by spaced apart protrusions of said evaporating pipes beyond said planar regions; and

* * * * *